US011596033B2

(12) United States Patent
Fossati et al.

(10) Patent No.: US 11,596,033 B2
(45) Date of Patent: Feb. 28, 2023

(54) CONDENSATION-MANAGING HAND-PROTECTING CAVITY VENTILATION SYSTEM

(71) Applicant: WHIRLPOOL CORPORATION, Benton Harbor, MI (US)

(72) Inventors: Laura Fossati, Comerio (IT); Luca Zilio, Biandronno (IT)

(73) Assignee: Whirlpool Corporation, Benton Harbor, MI (US)

( * ) Notice: Subject to any disclaimer, the term of this patent is extended or adjusted under 35 U.S.C. 154(b) by 267 days.

(21) Appl. No.: 16/896,489

(22) Filed: Jun. 9, 2020

(65) Prior Publication Data

US 2021/0385916 A1 Dec. 9, 2021

(51) Int. Cl.
*H05B 6/64* (2006.01)

(52) U.S. Cl.
CPC ..... *H05B 6/642* (2013.01); *H05B 6/6414* (2013.01)

(58) Field of Classification Search
CPC .. H05B 6/6402; H05B 6/6405; H05B 6/6414; H05B 6/642; H05B 6/6435; H05B 6/645; H05B 6/6473; H05B 6/6476; H05B 6/6479; H05B 6/6482; H05B 6/6485; H05B 6/725; H05B 6/74; H05B 6/76; H05B 6/766; F24C 15/003; F24C 15/006; F24C 15/02; F24C 15/025; F24C 15/04; F24C 15/32; F24C 15/322; F24C 15/325; F24C 15/327; F24C 15/36
USPC ..... 219/679, 680, 681, 756, 757
See application file for complete search history.

(56) References Cited

U.S. PATENT DOCUMENTS

| | | | | |
|---|---|---|---|---|
| 4,096,369 | A | 6/1978 | Tanaka et al. | |
| 5,272,302 | A * | 12/1993 | Dudley | H05B 6/6402 219/729 |
| 5,504,310 | A | 4/1996 | Bae | |
| 7,547,862 | B2 * | 6/2009 | Kim | F24C 15/04 219/681 |
| 2006/0186108 | A1 | 8/2006 | Kim et al. | |

FOREIGN PATENT DOCUMENTS

| | | | |
|---|---|---|---|
| CN | 105972653 | A | 9/2016 |
| CN | 208582244 | U | 3/2019 |
| CN | 208692963 | U | 4/2019 |
| EP | 2026633 | A2 | 2/2009 |
| EP | 1580488 | B1 | 6/2009 |
| EP | 2597930 | B1 | 7/2017 |
| GB | 2176378 | A | 12/1986 |
| KR | 20080024029 | A | 3/2008 |

* cited by examiner

*Primary Examiner* — Hung D Nguyen
(74) *Attorney, Agent, or Firm* — Brooks Kushman P.C.

(57) ABSTRACT

A hand protecting cavity ventilation system for an oven is provided. The system includes an air duct, positioned at a top of a cavity of the oven, the air duct having a duct outlet aimed toward a door to the cavity to provide an airflow along an inner surface of the door. The air duct extends downward from the ceiling of the cavity in front of and below a heating element disposed below the ceiling of the cavity. The air duct forms a vertically displaced hand protection portion to act as a barrier in front of the heating element, thereby guarding the heating element when the door of the oven is opened.

19 Claims, 5 Drawing Sheets

CONDENSATION-MANAGING HAND-PROTECTING CAVITY VENTILATION SYSTEM

TECHNICAL FIELD

Aspects of the disclosure relate to an oven cavity ventilation system for condensation management that also provides for protection of the operator.

BACKGROUND

Heat is generated by the magnetron and other components of a microwave oven. To cool these components, the oven draws in cool air and blows that air over the components. The oven then blows that same air through the oven cavity to carry away heat and smells produced within the oven cavity. This airflow also allows for condensation to be carried away and out of the oven.

SUMMARY

In one or more illustrative embodiments, a hand protecting cavity ventilation system for an oven is provided. The system includes an air duct, positioned at a top of a cavity of the oven, the air duct having a duct outlet aimed towards a door to the cavity to provide an airflow along an inner surface of the door. The air duct extends downward from the ceiling of the cavity in front of and below a heating element disposed below the ceiling of the cavity. The air duct forms a vertically displaced hand protection portion to act as a barrier in front of the heating element, thereby guarding the heating element when the door of the oven is opened.

In one or more illustrative embodiments, a hand protecting cavity ventilation system includes a heating element disposed at a top of a cavity of the oven. The system further includes an air duct having a duct outlet protruding from the top of the cavity above the heating element and extending to a position below the heating element near a door of the oven to achieve a dual function of conveying airflow in a downward direction and providing hand protection for the heating element.

In one or more illustrative embodiments, a hand protecting cavity ventilation system includes a ventilation plane including oven electronics; an oven cavity having an opening on a front face; a door having an opened position allowing access to the oven cavity and a closed position sealing the oven cavity; a heating element disposed below the ceiling of the cavity; and an air duct, positioned at a top of the cavity. The air duct has a duct inlet to receive air from the ventilation plane and a duct outlet aimed towards the door to provide an airflow along an inner surface of the door, wherein the air duct extends downward from the ceiling of the cavity in front of and below the heating element to form a vertically displaced hand protection portion to act as a barrier in front of the heating element, thereby guarding the heating element when the door of the oven is opened.

DETAILED DESCRIPTION

Figure 1:
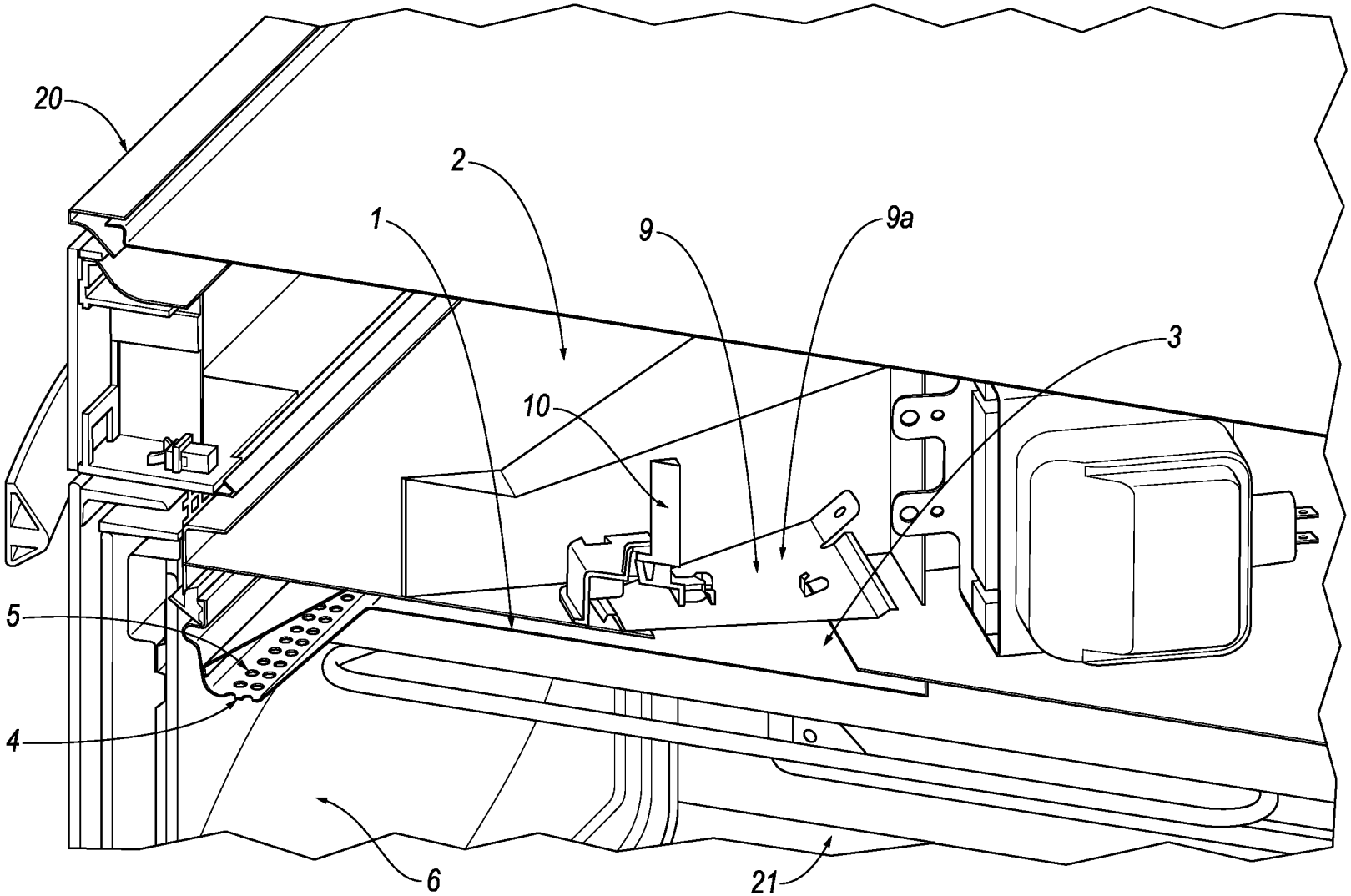
FIG. 1 illustrates a first view of a combi-oven including a condensation-managing hand protection feature.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A microwave oven draws in cool air from a vent, blows that air over the magnetron and other components of the microwave to cool them, and performs cavity ventilation using this same air to carry away heat, smells, and condensation produced within the oven cavity. This cavity ventilation may be achieved by providing this airflow to a duct extending into the oven cavity, where the airflow passes through the cavity and then out through a cavity outlet. The duct may be positioned within the cavity to provide the heated airflow along an inner glass surface of the microwave door (e.g., to the door glass facing the cavity side). This airflow along the inner surface of the microwave door is designed to keep the door free from condensation. The cavity outlet may be positioned to the rear of the oven cavity to allow the airflow to pass across the cavity before exiting.

Some microwaves include a heating element mounted to the ceiling of the oven cavity. These ovens may use the heating element to heat the air within the oven cavity, resulting in food that is cooked-through and crispy. This, combined with the microwave cooking, is called combination cooking, and produces quickly and evenly cooked food. Ovens providing for both microware and conventional cooking are sometimes referred to as combi-ovens.

As the combi-oven heating element is exposed within the cavity, it may be possible for an operator of the oven to accidentally touch the element when removing cooked items from the oven cavity. To avoid such occurrences, the duct may be extended into the oven cavity below and in front of the heating element disposed at the top of the oven cavity. Advantageously, a hand protection feature may be formed by a portion of the same air duct used for removing door condensation. This allows the air duct to perform both condensation management while the oven is being used as well as hand protection from the heating element when the door of the oven is opened.

Referring collectively to FIG. 1 through FIG. 5, a combi-oven 20 including a condensation-managing hand protection feature is depicted. In general, the oven 20 cooks food placed into an oven cavity 21 by exposing the food to electromagnetic radiation in the microwave frequency range. This radiation is produced by a magnetron, where electrons are emitted from a hot cathode to resonant cavities of the anode at speeds that generate the microwave energy. The oven cavity 21 may have an access opening and walls at the top, left side, right side, back and bottom. A door 6 may be arranged at a front of the oven cavity 21. The door 6 operate to move between an open position where the oven cavity 21 is accessible and a closed position where the door 6 seals the opening. To perform a cooking cycle, the food is placed in the oven cavity 21, the door 6 is closed, and the magnetron is activated. During operation, microwave energy travels from the magnetron through a waveguide and is distributed into the oven cavity 21. This energy transfers to the food via dielectric heating. The oven cavity 21 may be made of a material such as stainless steel or ceramic enamel, to prevent the passage of the radiation outside of the oven cavity 21. The door 6 may include a clear window for observing the food, shielded by a metal mesh to prevent the passage of the radiation. Once the food is heated, the magnetron is deactivated, the door 6 is reopened, and the food is removed. The oven 20 may also include a door switch (not shown) that detects whether the door 6 is open or closed, such that the magnetron is automatically deactivated should the door 6 be opened during a cooking cycle.

The magnetron and other components of the oven 20 produce waste heat when generating the microwave energy. Accordingly, the oven 20 includes an air duct 1 underneath a ventilation plane 2 of the oven 20 to draw this heat away. The ventilation plane 2 refers to the portion of the oven 20 including the magnetron and other components to be cooled. The air duct 1 provides an airflow channel that extends horizontally above the oven cavity 21 to connect the ventilation plane 2 with the forward section of the oven cavity 21. A duct inlet section 3 of the air duct 1 receives an airflow from the ventilation plane 2, while a duct outlet section 4 of the air duct 1 provides the airflow into the oven cavity 21. In some examples, to improve the flow of air, the air duct 1 increases in cross-sectional area in a direction of the airflow toward the duct outlet section 4.

The duct outlet section 4 of the air duct 1 defines a pattern of openings 5 placed on the lateral surface of the oven cavity 21. As shown in the illustrated example, the one or more openings 5 include an array of equally-sized, equally-spaced openings 5 (e.g., two rows of openings 5 across the lateral surface). It should be noted that this is merely an example arrangement of openings 5, and other possibilities are contemplated. In some other examples, the openings 5 may include irregularly-spaced or differently-sized openings, and/or one or more slots that run along the length or width of the duct outlet section 4. Regardless of layout, the airflow entering from the air duct 1 is provided to the oven cavity 21, where the airflow then circulates in the oven cavity 21 and is exhausted from the oven cavity 21 through an oven outlet section 7. The oven outlet section 7 may include an arrangement of cavity openings 8 through which the airflow exits the oven cavity 21, e.g., to pass into an exhaust vent away from the oven 20 or into a filter for recirculation into a room in which the oven 20 is placed.

Because the oven 20 operates by heating water molecules, the cooking process tends to generate steam. This steam may condense on the cooler inside surfaces of the oven cavity 21. This condensation may be more prevalent when cooking foods of high moisture content for extended periods of time. In these instances, the condensation may be especially noticeable to the user. In addition to cooling the magnetron, the airflow exiting from the ventilation plane 2 into the oven cavity 21 is hot and dry, and may advantageously be used to carry away the condensation, as well as providing an airflow circulation into the oven cavity 21 (e.g., for condensation management, odor reduction, heat management, etc.).

Figure 4:
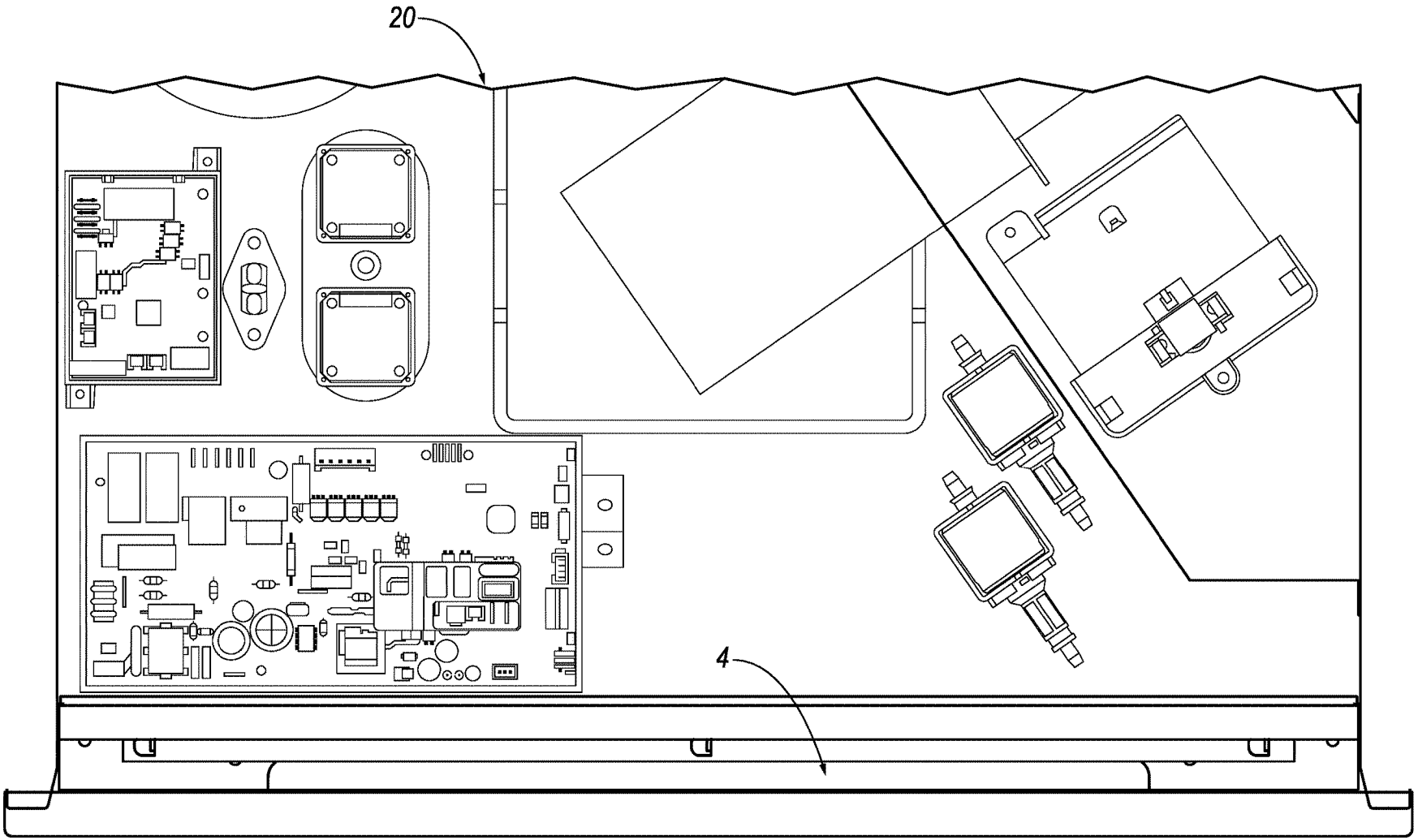
FIG. 4 illustrates a fourth view of a combi-oven including a condensation-managing hand protection feature.
Figure 5:
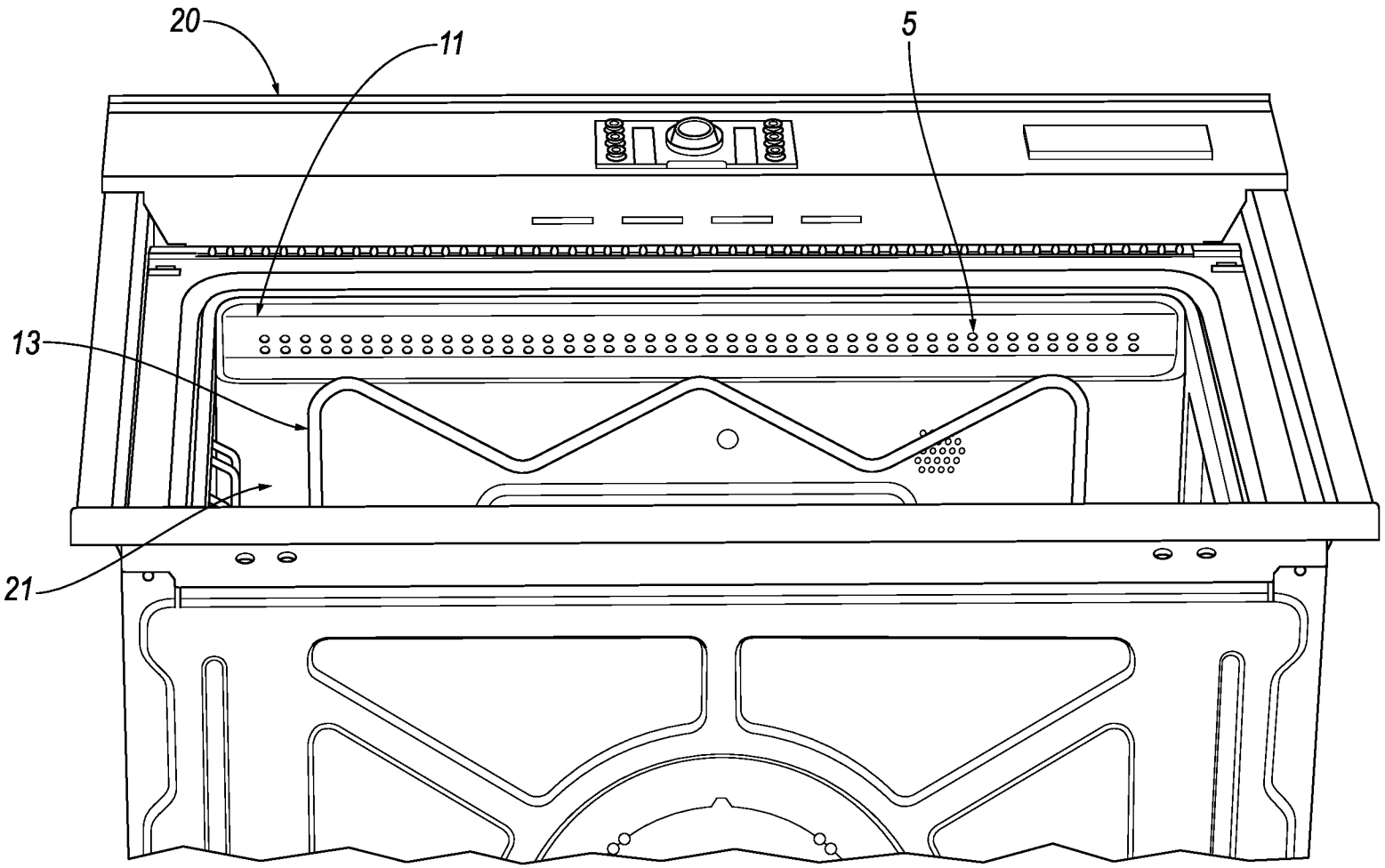
FIG. 5 illustrates a fifth view of a combi-oven including a condensation-managing hand protection feature.

The duct outlet section 4 of the air duct 1 may be located in close proximity to an inner glass surface of the door 6, to aid in removing water condensation from that inner surface. The lateral surface of the duct outlet section 4 may extend across the entire front lateral area of the door 6 as shown in FIGS. 4-5. Additionally or alternatively, the lateral surface of the duct outlet section 4 may extend only partially across the area of the door 6.

The described airflow may not always be necessary. In an example, use of the airflow may depend on the particular cooking function that is selected. In another example, use of the airflow may depend on how much humidity is sensed as being present in the oven cavity 21. In yet another example, the airflow may depend on whether predefined temperature set points within the oven cavity 21 have been reached. Based on these or other factors, the airflow through the oven cavity 21 may be regulated by operation of a valve 9 located in the ventilation plane 2 in correspondence with the duct inlet section 3 to the air duct 1. The valve 9 may allow for the selective separation of a portion of the main cooling flow of the magnetron and other oven electronics to be provided into the oven cavity 21.

The valve 9 can be selectively regulated into at least two positions: an open position and a closed position. When the valve 9 is in open position, shown as open valve 9*a* in FIG. 1, a portion of the cooling system airflow is separated out and directed into the air duct 1 underneath the ventilation plane 2 and then into the oven cavity 21. When the valve 9 is in closed position, as illustrated as closed valve 9*b* in FIG. 2, this spillage effect is disengaged and the air duct 1 underneath the ventilation plane 2 is bypassed. Accordingly, in the closed position, no ventilation of the oven cavity 21 is performed.

Figure 2:
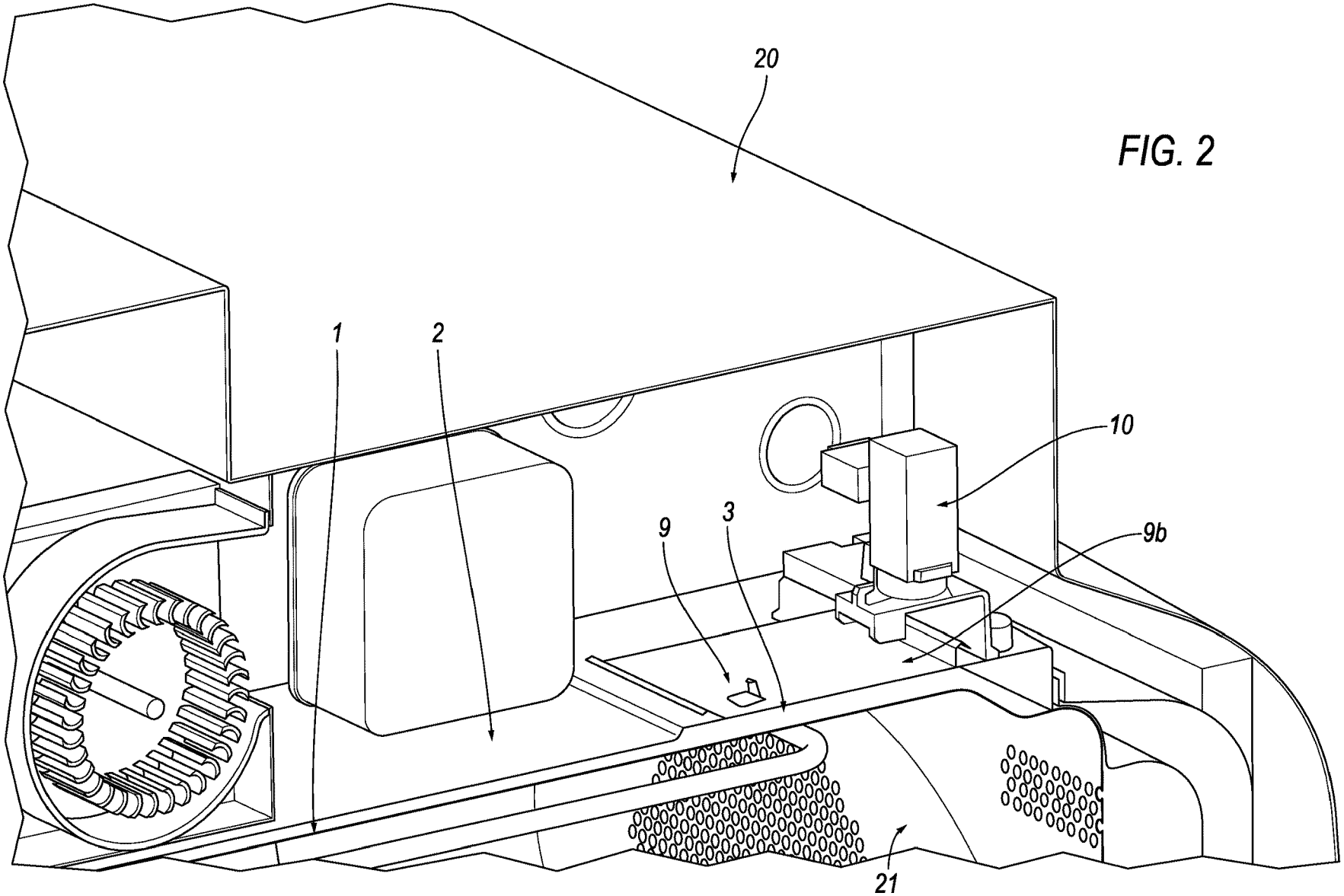
FIG. 2 illustrates a second view of a combi-oven including a condensation-managing hand protection feature.
Figure 3:
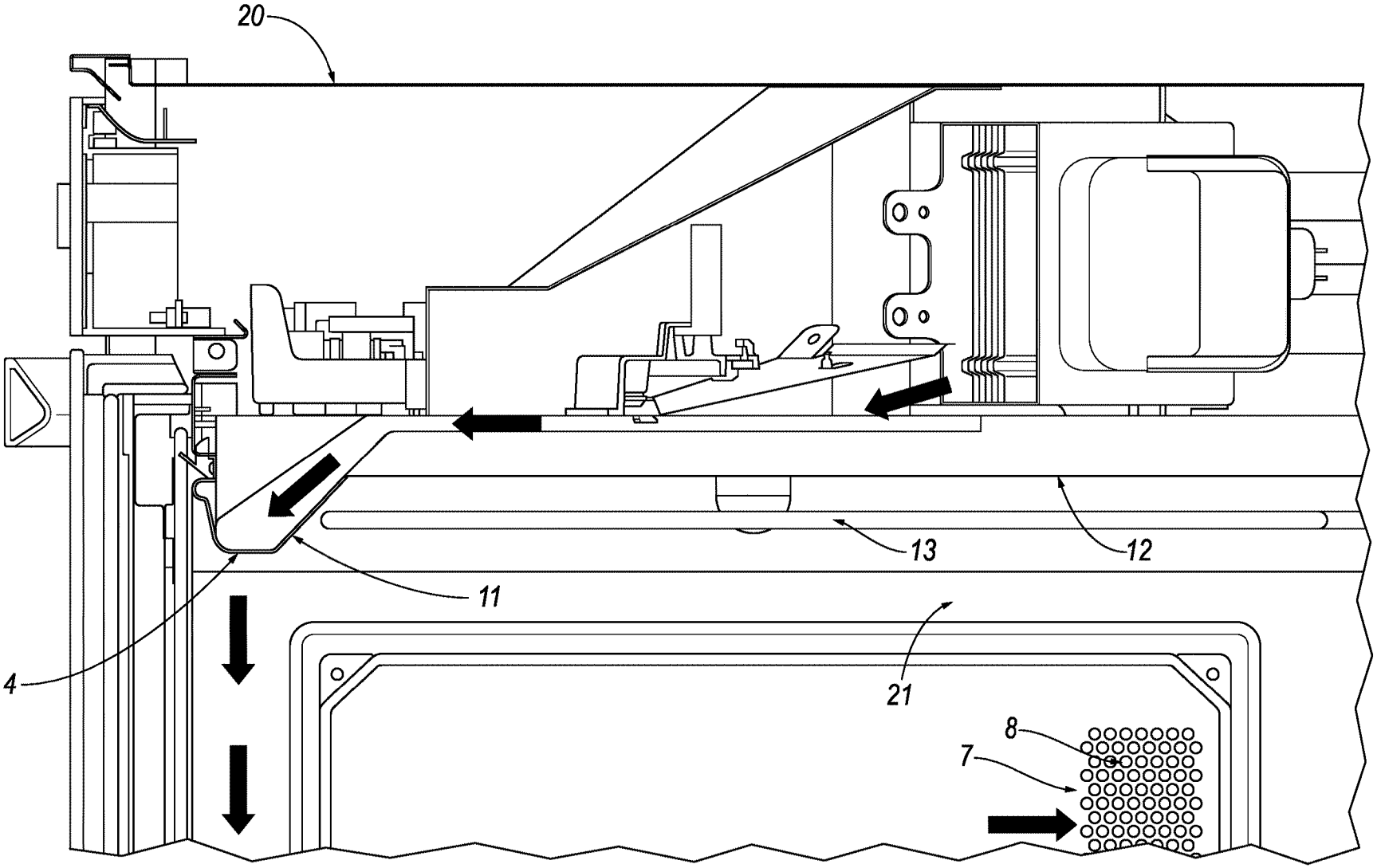
FIG. 3 illustrates a third view of a combi-oven including a condensation-managing hand protection feature.

The valve 9 may be regulated by a dedicated actuator 10, which may be used to control positioning of the valve 9 between the open position and the closed position. In a preferable embodiment, the valve 9 may have the two positions (open and closed) as shown in FIGS. 1-2. However, it is possible that in other examples the positioning of the valve 9 may additionally or alternately be controllable into one or more intermediate positions, between the open position and the closed position, to allow for the regulation of how much airflow is to be provided into the oven cavity 21.

The oven 20 may also include a heating element 13 to provide for baking. The heating element 13 may be a resistive heating element configured to heat the air of the oven cavity 21, either alone or in combination with the microwave energy provided via the magnetron. As shown, the heating element 13 may generally be mounted below a top surface or ceiling 12 of the oven cavity 21. Use of the heating element 13, combined with the operation of the magnetron, may aid in the quick and even cooking of food.

The heating element 13 tends to remain hot after a cooking cycle of the oven 20 is completed. As the heating element 13 is exposed within the oven cavity 21, it may be possible for an operator of the oven 20 to accidentally touch the still-hot heating element 13 when removing heated items from the oven cavity 21. To protect the operator, the air duct 1 may form a hand protection portion 11 at the duct outlet section 4. The hand protection portion 11 of the air duct 1 may extend from the top ceiling 12 of the oven cavity 21 in front of the heating element 13 to prevent accidental operator contact with the heating element 13. As shown, the duct outlet protrudes from the top of the oven cavity 21 in front of the heating element 13, and extends to a position below the heating element 13 near a door 6 of the oven 20, to achieve a dual function of conveying airflow in a downward direction and also providing hand protection for the heating element 13.

As shown, a front surface of the hand protection portion 11 of the duct outlet section 4 may be rounded, e.g., as a fillet, to curve downward from the front ceiling of the oven cavity 21 to form a front portion of the hand protection portion 11. The hand protection portion 11 may further define a lateral surface extending rearward toward the back of the oven cavity 21, leading to a sloped surface extending rearward and upward toward the ceiling of the oven cavity 21. In some examples, the heating element 13 is mounted a first distance below the top ceiling 12 of the oven cavity 21, and the duct outlet section 4 of the air duct 1 is mounted a second distance below the top ceiling 12 of the oven cavity 21, where the second distance is greater than the first distance.

The hand protection portion 11 of the duct outlet section 4 may be integral with the ceiling 12 of the oven cavity 21. For instance, the hand protection portion 11 may be molded as part of the oven cavity 21 itself. In such a case, the duct outlet section 4 may be formed of the same material as the oven cavity 21 itself, such as stainless steel or ceramic enamel. In other examples, the hand protection portion 11 of the duct outlet section 4 may be a separate element. In such a case, the hand protection portion 11 may be formed of a material the same as that of the oven cavity 21 and/or of another material, such as a metal or ceramic capable of withstanding the heat present within the oven cavity 21 in proximity to the heating element 13.

The duct outlet section 4 of the air duct 1 may be provided on the lateral surface of the hand protection portion 11. In doing so, the pattern of openings 5 of the duct outlet section 4 of the air duct 1 may therefore be embedded within the hand protection portion 11 itself. Accordingly, the hand protection portion 11 affords both protection from accidental contact with the heating element 13 and the providing of airflow from duct outlet section 4 into the oven cavity 21. Moreover, the protrusion of the hand protection portion 11 into the oven cavity 21, as compared to the duct outlet section 4 of the air duct 1 being flush with the ceiling of the oven cavity 21, allows for the airflow from the duct outlet section 4 of the air duct 1 to be better addressed towards the glass inner surface of the door 6.

Thus, the air duct 1 for removing oven condensation may be provided that extends below the heating element 13 disposed at the top of the oven cavity 21. As the hand protection portion 11 extends downward from the ceiling of the oven cavity 21 in front of and below the heating element 13, the air duct 1 also acts as the hand protection portion 11 when the door 6 of the oven 20 is opened. This allows the air duct 1 to perform both condensation management and hand protection functions.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The abstract of the disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A hand protecting cavity ventilation system for an oven comprising:

an air duct, positioned at a top of a cavity of the oven, the air duct having a duct outlet aimed towards a door to the cavity to provide an airflow along an inner surface of the door, the air duct extending downward from the ceiling of the cavity in front of and below a heating element disposed below the ceiling of the cavity, wherein the air duct forms a vertically displaced hand protection portion to act as a barrier in front of the heating element, thereby guarding the heating element when the door of the oven is opened, wherein the duct outlet defines one or more openings along the vertically displaced hand protection portion of the duct outlet to direct the airflow downward toward the door of the oven.

2. The system of claim 1, wherein the one or more openings include an array of equally-sized holes.

3. The system of claim 1, wherein the one or more openings include an array of equally-spaced holes.

4. The system of claim 1, wherein the air duct increases in cross-sectional area in a direction of the airflow toward the duct outlet.

5. The system of claim 1, wherein the heating element is mounted a first distance below the ceiling of the oven cavity, the air duct is mounted a second distance below the ceiling of the oven cavity, and the second distance is greater than the first distance to achieve the hand protection function.

6. The system of claim 1, wherein a front surface of the air duct curves upward from the duct outlet to form a front of the hand protection portion.

7. The system of claim 1, wherein the inner surface of the door is a glass surface.

8. The system of claim 1, wherein the duct outlet is integral with the top ceiling of the cavity.

9. The system of claim 1, wherein the duct outlet is formed of one or more of stainless steel or ceramic enamel.

10. The system of claim 1, wherein the oven is a microwave oven and the airflow is heated by passage over a magnetron of the oven.

11. A cavity ventilation system for an oven, comprising:

a heating element disposed at a top of a cavity of the oven; and an air duct having a duct outlet protruding from the top of the cavity above the heating element and extending to a position below the heating element near a door of the oven to achieve a dual function of conveying airflow in a downward direction and providing hand protection for the heating element, wherein the duct outlet defines one or more openings along at least a portion of the duet outlet extending to the position below the heating element, to direct the airflow downward toward the door of the oven.

12. The system of claim 11, wherein the air duct is aimed towards the door to provide the airflow along an inner surface of the door.

13. The system of claim 12, wherein the air duct is positioned to act as a barrier in front of the heating element, thereby guarding the heating element from a hand of an operator when the door of the oven is opened.

14. The system of claim 12, wherein the air duct blocks contact with the heating element via horizontal movement of a hand of an operator of the oven.

15. A cavity ventilation system for an oven, comprising:

a ventilation plane including oven electronics;

an oven cavity having an opening on a front face;

a door having an opened position allowing access to the oven cavity and a closed position sealing the oven cavity;

a heating element disposed below the ceiling of the cavity; and an air duct, positioned at a top of the cavity, the air duct having a duct inlet to receive air from the ventilation plane and a duct outlet aimed towards the door to provide an airflow along an inner surface of the door, wherein the air duct extends downward from the ceiling of the cavity in front of and below the heating element to form a vertically displaced hand protection portion to act as a barrier in front of the heating element, thereby guarding the heating element when the door of the oven is opened, wherein the duct outlet defines one or more openings along at least a portion of the duct outlet extending below the heating element to direct the airflow downward toward the door of the oven.

16. The system of claim 15, wherein the one or more openings include an array of equally-sized, equally-spaced holes.

17. The system of claim 15, wherein the air duct increases in cross-sectional area in a direction of the airflow toward the duct outlet.

18. The system of claim 15, wherein the heating element is mounted a first distance below the ceiling of the oven, the air duct extends a second distance below the ceiling of the oven, and the second distance is greater than the first distance to achieve the hand protection function.

19. The system of claim 15, wherein the duct outlet is integral with the top ceiling of the cavity.

* * * * *